United States Patent [19]

Keller

[11] Patent Number: 4,905,489

[45] Date of Patent: Mar. 6, 1990

[54] TUMBLER IN A CYLINDER LOCK

[76] Inventor: Ernst Keller, Untere Schwandenstrase 22, CH-8805 Richterswil, Switzerland

[21] Appl. No.: 133,049

[22] PCT Filed: Mar. 12, 1987

[86] PCT No.: PCT/CH87/00032

§ 371 Date: Dec. 14, 1987

§ 102(e) Date: Dec. 14, 1987

[87] PCT Pub. No.: WO87/05654

PCT Pub. Date: Sep. 24, 1987

[30] Foreign Application Priority Data

Mar. 13, 1986 [CH] Switzerland ..... 1032/86

[51] Int. Cl.[4] ..... E05B 27/04

[52] U.S. Cl. ..... 70/378; 70/493

[58] Field of Search ..... 70/378, 376, 364, 392, 70/421, 357, 358, 419

[56] References Cited

U.S. PATENT DOCUMENTS

| | | | |
|---|---|---|---|
| 593,436 | 11/1987 | Rydberg | 70/364 R X |
| 1,095,500 | 5/1914 | Hansen | 70/359 |
| 1,244,304 | 10/1917 | Epstein | 70/421 |
| 1,257,987 | 3/1918 | Epstein | 70/359 |
| 1,594,033 | 7/1926 | Anakin | 70/364 A |
| 2,022,079 | 11/1935 | Williams et al. | 70/359 X |
| 2,111,515 | 3/1938 | Rauh | 70/419 |
| 2,287,175 | 6/1942 | Heyer | 70/421 |
| 3,494,158 | 2/1970 | Bauer et al. | 70/364 A |
| 3,499,302 | 3/1970 | Spain et al. | 70/364 A |
| 3,818,732 | 6/1974 | Tria, Jr. et al. | 70/359 |
| 4,142,389 | 3/1979 | Bahry et al. | 70/359 |
| 4,403,486 | 9/1983 | Miyake | 70/378 X |
| 4,667,495 | 5/1987 | Girard et al. | 70/421 X |

FOREIGN PATENT DOCUMENTS

| | | | |
|---|---|---|---|
| 954326 | 9/1974 | Canada | 70/364 A |
| 1037312 | 8/1958 | Fed. Rep. of Germany | 70/364 A |
| 1122866 | 1/1962 | Fed. Rep. of Germany | . |
| 909253 | 12/1945 | France | 70/364 A |
| 935899 | 2/1948 | France | 70/364 A |

*Primary Examiner*—Lloyd A. Gall

*Attorney, Agent, or Firm*—Browdy and Neimark

[57] ABSTRACT

The spring loaded tumbler is provided with a casing and a core. Latter has a limited travel towards the key passage, and is located in a stepped drilling in the cylindrical core. A sliding sleeve element is located on the core, which has a corresponding shape to that of the stepped drilling. The tumbler according to the present invention can be inserted in normal cylinder locks and effectively prevents unauthorized opening without the use of a key or damage to the lock.

10 Claims, 3 Drawing Sheets

TUMBLER IN A CYLINDER LOCK

BACKGROUND OF THE INVENTION

1. Field of the Invention:

The invention relates to a tumbler in a cylinder lock having a core pin and a spring-loaded housing pin, which are supported in a radial bore of the cylinder housing and in a bore of the cylinder core, respectively, and which are brought into alignment by an insertable key introduced into the key channel.

2. The Prior Art:

Cylinder locks having two-part tumblers are well known and have a high degree of security. However, unlocking methods have now been developed with which these cylinder locks can be opened without keys and without externally apparent damage to the locks.

SUMMARY OF THE INVENTION

It is now the object of the invention to devise a cylinder lock of the above type which cannot be opened with these methods.

This object is attained in accordance with the invention by providing that the core pin has a sheath-like slide element, which is disposed behind the head of the core pin and is displaceable in the longitudinal direction with respect to the bore and to the core pin. The effective portion of the tumbler always remains movable if the aforementioned unlocking methods are used, so that its measurements cannot be learned. Unlocking methods involving the use of force also fail, because once again the effective portion of the core pin cannot be fixed in place.

The tumbler according to the invention is simple to mass produce. No modifications to the other parts of the cylinder lock or to the key are necessary. The cylinder lock can be adequately secured against the above unlocking methods by using at least one tumbler according to the invention, along with the usual tumblers, in the cylinder lock.

By manufacturing the tip of the core as a separate part and securing the tip with an interference fit on the pin body, it becomes possible to make the tip from a material that is especially secure against being drilled open. If the tip is made from a hard metal material, wearing down of the tip from use is moreover largely avoided.

The embodiment of the tumbler in which the core pin has a bore, in which a locking pin that is displaceable in the longitudinal direction with an outward limitation by a stop is supported, and disposed in the bore is a compression spring, which presses in a biased manner upon the locking pin, which in turn presses against the housing pin, additionally prevents unlocking methods in which the core and housing pins are separated so that the rotor can be rotated briefly.

Further advantageous embodiments are disclosed in the dependent claims.

BRIEF DESCRIPTION OF THE DRAWINGS

Exemplary embodiments of the invention will be described below in further detail, referring to the drawings, in which.

DETAILED DESCRIPTION OF THE PREFERRED EMBODIMENTS

Figure 2:
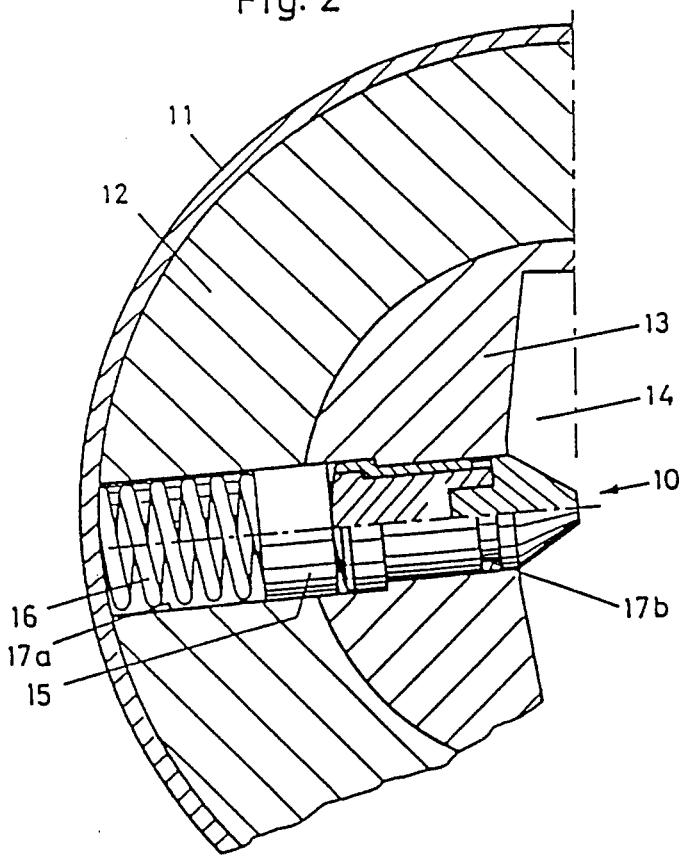
FIG. 2 shows a cross section through a portion of a cylinder lock with a tumbler inserted, the tumbler being shown partly in projection and partly in section.

In a known manner, the lock cylinder shown in FIG. 2 has a stationary cylinder housing 12, which is located in a cylindrical sheath 11 and in which a cylinder core 13 is rotatably disposed. The cylinder housing 12 and the cylinder core 13 have radial bores 17*a* and 17*b*, in which spring-loaded tumblers are displaceably supported. One spring 16 is located in each housing bore 17*a*, supported against the sheath 11 and pressing in a biased manner against a housing pin 15, which in turn presses a core pin 10 radially inward against a key that is to be introduced into the key channel 14.

Figure 1:
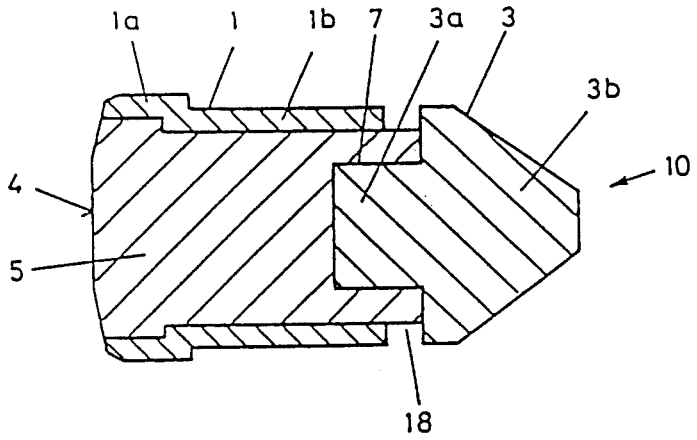
FIG. 1 shows a longitudinal section through a core pin.

As FIG. 1 shows, the core pin 10 has a tip 3, which includes a connecting portion 3*a* and a head 3*b* having a control face. The head 3*b* may also have a plurality of control faces, however, to increase the number of locking possibilities in a known manner. The tip 3 preferably comprises a hard metal material, or some other mechanically resistant material that is secure against being drilled open and is wear-resistant, and is secured with an interference fit in a bore 7 in the pin body or shaft 5.

A sheathlike slide element 1 is displaceably supported on the body 5. Both the slide element 1 and the body 5 are offset in diameter in stepped fashion on the outer end, so that the slide element 1 is outwardly displaceable in a manner limited by a stop and has a wider sheath portion 1*a* and a narrower sheath portion 1*b*. Inwardly, the sheath portion 1*b* of the slide element 1 is limited by a stop in the form of the radially outwardly protruding head 3*b*.

Figure 3A:
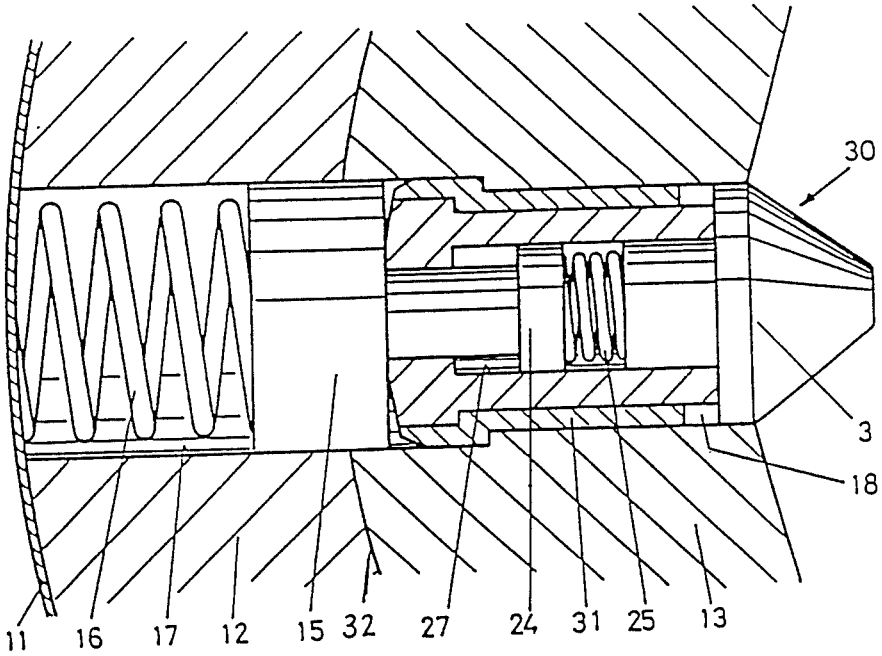
FIGS 3*a* and 3*b* shows a cross section through a cylinder lock with a tumbler in accordance with a variant of the present invention.
Figure 3B:
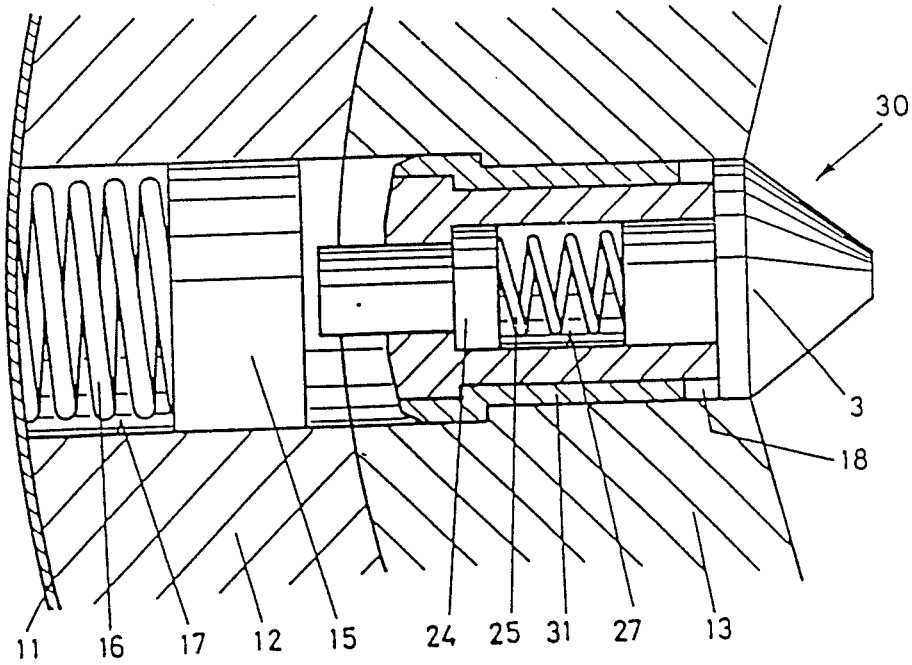

In FIGS. 3*a* and 3*b*, a core pin 30 is shown which besides the slide element 1 additionally has a locking pin 24. The locking pin is supported in a stepped bore 27 in the pin body 26 such that it is outwardly limited by a stop. A compression spring 25 is located in the stepped bore 27, supported against the tip 3 and pressing in a biased manner against the locking pin 24, which on its outer end rests on the housing pin 15. The tension of the spring 25 is selected such that the locking pin 24 does not move the housing pin 15 out of its position that locks the cylinder. In the position shown in FIG. 3*a*, however, the spring 25 does have a tension great enough that the locking pin 24 follows the housing pin 15 substantially without any delay when the two pins are separated from one another.

The mode of operation of the locking pin 24 is shown schematically in FIG. 3*b*. The housing pin 15 is briefly moved here, by a known unlocking method, into an unlocked position, while the core pin 30 remains in its original position. Nevertheless, the cylinder core cannot be rotated, because the locking pin 24 projects beyond the shear plane 32 and locks the cylinder.

The core pins 10 and 30 can be inserted into the usual stepped bores 17*b* in the cylinder core 13. Because of the stepped embodiment of the bore 15*b* and a corresponding stepped embodiment of the slide element 1, the displaceability of the slide element 1 and of the entire core pin 10 or 30 toward the key channel 14 is limited.

Figure 4:
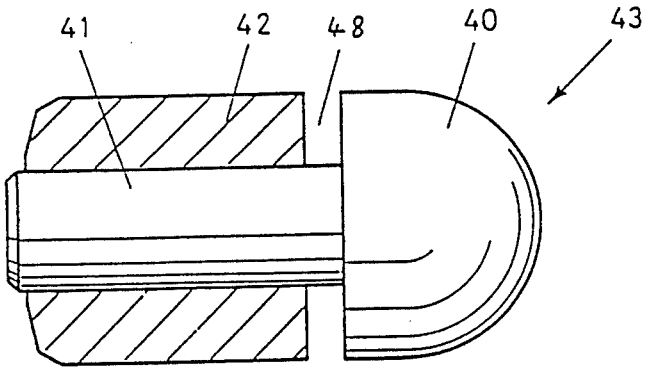
FIG. 4 shows a longitudinal section through a core pin in accordance with a further version of the present invention.

The core pin can also be embodied as shown in FIG. 4. In this core pin 43, the body is manufactured in one piece and has a cylindrical shank 41 and a head 40 having an approximately hemispherical control face. A cylindrical slide element 42, which is somewhat shorter than the shank 41, is displaceably supported on the shank 41. Upon a displacement in the axial direction, the sheathlike slide element 42 meets a stop at the head 40 in the inward direction and a stop on the housing pin 15, not shown here and embodied as described above, in the outward direction. The core pin 43 is particularly cost-effective in its manufacture and is particularly well suited for a cylinder lock having a serrated type of key.

The above-described core pins 10, 30 and 43 have an annular gap 18 or 48, respectively, between the slide element 1 or 42 and the head 3 or 40, respectively. These gaps are approximately 0.4 mm wide, viewed in the longitudinal direction of the core pin and are formed because the slide element is shorter by 0.4 mm than the body of the corer pin. The slide element may be between 0.3 mm and 0.7 mm shorter than the body. A compression spring 19 (shown only in FIG. 3*a*), which presses the slide element 1 against the shoulder of the pin body 5, or the slide element 42 against the housing pin 15, can be disposed in the gaps 18 and 48, respectively. The tension of this compression spring is comparatively low but assures that the gap 18 is maintained when the core pin 10, 30 or 43 is displaced outward. In the version of FIG. 4, this compression spring has the further advantage that the slide element 42 in this case also assumes the mode of operation of the locking pin 24. The slide element 42 and the compression spring thus effectively prevent the lock from being unlocked by separating the core and housing pins, and also at the same time assure that the effective portion of the core pin always remains movable during attempts to force the lock or gauge its measurements.

When the lock is opended by an authorized person using the proper key, the tumbler according to the invention functions in the same manner as a conventional tumbler.

I claim:

1. A tumbler for a rotary cylinder lock having a cylindrical housing and a cylindrical core, said tumbler comprising:

a core pin having a cylindrical core pin body;

a spring-loaded housing pin;

said core pin and said housing pin being respectively mounted in a radial bore formed in the cylindrical housing and a bore of the cylindrical core and being adapted for inserting an insertion key into a keyhole;

an exteriorly protruding radial head connected at one end of the cylindrical core pin body of said core pin; and a casing shaped sliding element mounted behind said head over said cylindrical core pin body so as to be slidingly adjustable in a longitudinal direction of the bore in the cylindrical core and with respect to said core pin, said sliding element having an inner end which is adapted to be struck by said exteriorly protruding radial head, said sliding element being shorter than the cylindrical core pin body and said cylindrical core pin body having an outer diameter which is less than a diameter of the said radial bore of the cylindrical core and wherein the sliding element and the core pin body are offset in diameter at the rear end, corresponding with a step in the bore in the cylindrical core.

2. A tumbler for a rotary cylinder lock according to claim 1, wherein at least a portion of said head adjacent to the cylindrical core pin body has a diameter greater than the diameter of the cylindrical core pin body.

3. A tumbler as defined by claim 1 wherein the head of the core pin is manufactured as a separate part and is secured with an interference fit in a bore in the cylindrical body of the core pin.

4. A tumbler as defined by claim 3, wherein the head is manufactured from a hard metal material.

5. A tumbler as defined by claim 1, wherein the core pin has a cylindrical shank for receiving the sliding element.

6. A tumbler as defined by claim 5, wherein the sliding element is cylindrical in shape.

7. A tumbler as defined by claim 5, wherein the head of the core pin is integrally formed onto the shank.

8. A tumbler for a rotary cylinder lock comprising: a core pin and a spring-loaded housing pin which are respectively mounted in a radial bore formed in a cylindrical housing and in a bore of a cylindrical core, and which are adapted for inserting an insertion key into a kekyhole, the core pin is provided with an exteriorly protruding radial head at one end thereof, a casing shaped sliding element is mounted behind the head of the core pin, the sliding element being slidingly adjustable in longitudinal direction of the bore and with respect to the core pin, an inner end of the sliding element being adapted to be struck by the exteriorly protruding radial head, the core pin body having a cylindrical shaft connected to the head, the sliding element being slidably mounted over the cylindrical corer pin body shaft, being shorter than the core pin body cylindrical shaft and the outer diameter of the core pin body cylindrical shaft being less than the diameter of the bore of the cylindrical core and wherein the sliding element and the core pin body is manufactured as a separate part and is secured with an interference fit in a bore in the cylindrical body of the core pin body.

9. A tumbler for a rotary cylinder lock having a cylindrical housing and a cylindrical core, said tumbler comprising:

a core pin having a cylindrical core pin body;

a spring-loaded housing pin;

said core pin and said housing pin being respectively mounted in a radial bore formed in the cylindrical housing and a bore of the cylindrical core and being adapted for inserting an insertion key into a keyhole;

an exteriorly protruding radial head connected at one end of the cylindrical core pin body of said core pin; and a casing shaped sliding element mounted behind said head over said cylindrical core pin body so as to be slidingly adjustable in a longitudinal direction of the bore in the cylindrical core and with respect to said core pin, said sliding element having an inner end which is adapted to be struck by said exteriorly protruding radial head, said sliding element being shorter than the cylindrical core pin body and said cylindrical core pin body having an outer diameter which is less than a diameter of the said radial bore of the cylindrical core and wherein the sliding element and the core pin body are offset in diameter at the rear end, corresponding with a step in the bore in the cylindrical core wherein the core pin has a bore in which a locking pin that is displaceable in the longitudinal direction with an outward limitation by a stop is supported, and disposed in the bore is a compression spring, which presses in a biased manner upon the locking pin, which in turn presses against the housing pin.

10. A tumbler for a rotary cylinder lock having a cylindrical housing and a cylindrical core, said tumbler comprising:

a core pin having a cylindrical core pin body;

a spring-loaded housing pin;

said core pin and said housing pin being respectively mounted in a radial bore formed in the cylindrical housing and a bore of the cylindrical core and being adapted for inserting an insertion key into a keyhole;

an exteriorly protruding radial head connected at one end of the cylindrical core pin body of said core pin; and a casing shaped sliding element mounted behind said head over said cylindrical core pin body so as to be slidingly adjustable in a longitudinal direction of the bore in the cylindrical core and with respect to said core pin, said sliding element having an inner end which is adapted to be struck by said exteriorly protruding radial head, said sliding element being shorter than the cylindrical core pin body and said cylindrical core pin body having an outer diameter which is less than a diameter of the said radial bore of the cylindrical core and wherein the sliding element and the core pin body are offset in diameter at the rear end, corresponding with a step in the bore in the cylindrical core wherein the sliding element is shorter than a body portion of the core pin, forming a gap between the sliding element and the head of the core pin and wherein the core pin has a compression spring disposed in the gap for pressing the sliding element outward.

* * * * *